US005609235A

United States Patent [19]

Schwarzli

[11] Patent Number: 5,609,235

[45] Date of Patent: Mar. 11, 1997

[54] COIN MECHANISM WITH MAGNETIC COIN DISCRIMINATOR

[75] Inventor: Josef W. Schwarzli, Stouffville, Canada

[73] Assignee: Machine-O-Matic Limited, Newmarket, Canada

[21] Appl. No.: 542,773

[22] Filed: Oct. 13, 1995

[30] Foreign Application Priority Data

Aug. 23, 1995 [CA] Canada ..... 2156787

[51] Int. Cl.[6] ..... G07F 5/02

[52] U.S. Cl. ..... 194/320

[58] Field of Search ..... 194/202, 236, 194/237, 255, 292, 320, 321, 322, 323, 325

[56] References Cited

U.S. PATENT DOCUMENTS

| | | | |
|---|---|---|---|
| 1,838,907 | 12/1931 | DuGrenier | 194/322 |
| 1,869,616 | 8/1932 | Radtke | 194/321 |
| 1,982,274 | 11/1934 | Vogel | 194/322 |
| 2,066,820 | 1/1937 | Brown | 194/320 X |
| 2,091,232 | 8/1937 | Vogel et al. | 194/320 |
| 3,168,947 | 2/1965 | Greenwald | 194/236 |
| 3,317,016 | 5/1967 | Turillon | 194/319 |
| 5,383,545 | 1/1995 | Schwarzli | 194/236 X |
| 5,509,521 | 4/1996 | Bolen | 194/325 X |

*Primary Examiner*—F. J. Bartuska
*Attorney, Agent, or Firm*—Mark B. Eisen

[57] ABSTRACT

A coin mechanism for a bulk vendor or the like is provided with a magnetic discriminating device, for selectively accepting coins having a magnetic component and rejecting coins or slugs which have no magnetic component. A magnet is lodged in the coin conveyor flush with the seating surface for a coin, and a resilient urging member such as a spring projects above the seating surface. The attractive force of the magnet on a coin having a magnetic component is greater than the repelling force of the spring, so a coin having a magnetic component is retained in the coin carrier while a coin or slug having no magnetic component is unseated by the spring and ejected into a coin rejection chute.

20 Claims, 6 Drawing Sheets

COIN MECHANISM WITH MAGNETIC COIN DISCRIMINATOR

FIELD OF INVENTION

This invention relates to coin mechanisms for vending machines. In particular, this invention relates to a coin mechanism for a bulk vendor or other apparatus, having a magnetic coin discriminator that rejects any coin or slug which does not have a magnetic component.

BACKGROUND OF THE INVENTION

Rotary coin mechanisms are widely used in merchandise-dispensing machines such as bulk vendors for dispensing gumballs and other small articles. An example of such a coin mechanism is described and illustrated in U.S. Pat. No. 5,383,545 issued Jan. 24, 1995 to Schwarzli, which is incorporated herein by reference.

Bulk vendors are designed for self service by users with minimal maintenance, and as such are frequently placed in locations where their use cannot be readily supervised. As a result bulk vendors are constantly subjected to attempts to steal merchandise, usually by children and adolescents.

By far the most common type of theft from bulk vendors involves the use of "slugs" approximating the size of the coins which the coin mechanism is designed to accept. This has led to the development of measuring devices with fairly precise tolerances, capable of determining the thickness and diameter of the inserted coin to within a few thousandths of an inch. However, while in the past slugs were commonly cut or stamped out of sheet metal metal, more recently slugs composed of plastic or sturdy cardboard have become popular due to their low cost and the ease with which such slugs can be produced to the required size.

Cardboard slugs present a particular problem in bulk vendors, because of the manner in which a conventional rotary coin mechanism discriminates between coins of the intended denomination and other coins or slugs. A coin recess is provided in a rotating coin conveyor disc, and a pair of dogs respectively measure the thickness and diameter of the inserted coin or slug. Either dog will arrest rotation of the mechanism if the diameter or thickness does not match that of the intended denomination of coin. However, in the case of slightly oversized cardboard slugs of the correct thickness, repeated attempts to force the mechanism to turn with the slug in the coin recess actually result in gradual wearing away of the edge of the slug, and once the edge has worn to a size within the tolerance of the measuring dog the mechanism will accept the slug. This has become a significant problem resulting in extensive losses to bulk vendor operators.

SUMMARY OF THE INVENTION

The present invention overcomes this problem by providing a rotary coin mechanism for a bulk vendor which discriminates between coins magnetically so that only coins containing a magnetic component such as iron will be accepted by the mechanism. Plastic and cardboard slugs, and metal slugs containing no magnetic component, are rejected by the coin mechanism of the invention and fall into the housing of the bulk vendor remote from the coin tray. This is accomplished without interfering with the devices for measuring the size of an inserted coin, and as such provides an additional method of discriminating between coins of the proper denomination and other coins or slugs.

The invention accomplishes this by providing a magnet in the coin recess of the coin conveyor, in combination with urging means such as a spring having a repelling force which is less than the attractive force of the magnet on a coin having a magnetic component. In this manner a coin of the appropriate size having a magnetic component is retained in the coin recess, allowing the mechanism to rotate through its dispensing cycle, while a coin or slug having no magnetic component is unseated from the coin recess at the beginning of the rotation cycle and is ejected into the vendor housing before the coin mechanism passes the rotation threshold for accepted coins.

The present invention thus provides a rotatably mounted coin conveyor connected to means for rotating the coin conveyor and means for dispensing merchandise from the apparatus responsive to rotation of the coin conveyor, the coin conveyor including carrying means for carrying a coin or token along a rotational path of the carrying means, a cover plate having an opening for the insertion of a coin or token in substantial alignment with the carrying means when the coin conveyor is in a rest position, the carrying means being provided with magnetized means for attracting a coin or token having a magnetic component and retaining same in the carrying means and urging means for repelling a coin or token having no magnetic component and unseating same from the carrying means, whereby an attractive force of the magnetized means is greater than a repelling force of the urging means, and means for releasing the coin or taken from the carrying means as the coin conveyor is rotated past a coin deposit position.

The present invention further provides an apparatus for dispensing merchandise having a coin mechanism comprising a rotatably mounted coin conveyor connected to means for rotating the coin conveyor and means for dispensing merchandise from the apparatus responsive to rotation of the coin conveyor, the coin conveyor including carrying means for carrying a coin or token along a rotational path of the carrying means, a cover plate having an opening for the insertion of a coin or token in substantial alignment with the carrying means when the coin conveyor is in a rest position, the carrying means being provided with magnetized means for attracting a coin or token having a magnetic component and retaining same in the carrying means and urging means for repelling a coin or token having no magnetic component and unseating same from the carrying means, whereby an attractive force of the magnetized means is greater than a repelling force of the urging means, and means for releasing the coin or token from the carrying means as the coin conveyor is rotated past a coin deposit position.

BRIEF DESCRIPTION OF THE DRAWINGS

In drawings which illustrate by way of example only a preferred embodiment of the invention, FIG. 4*a* is a partial elevation of a measuring dog mounted in the coin mechanism of FIG. 2.

DETAILED DESCRIPTION OF THE INVENTION

Figure 1:
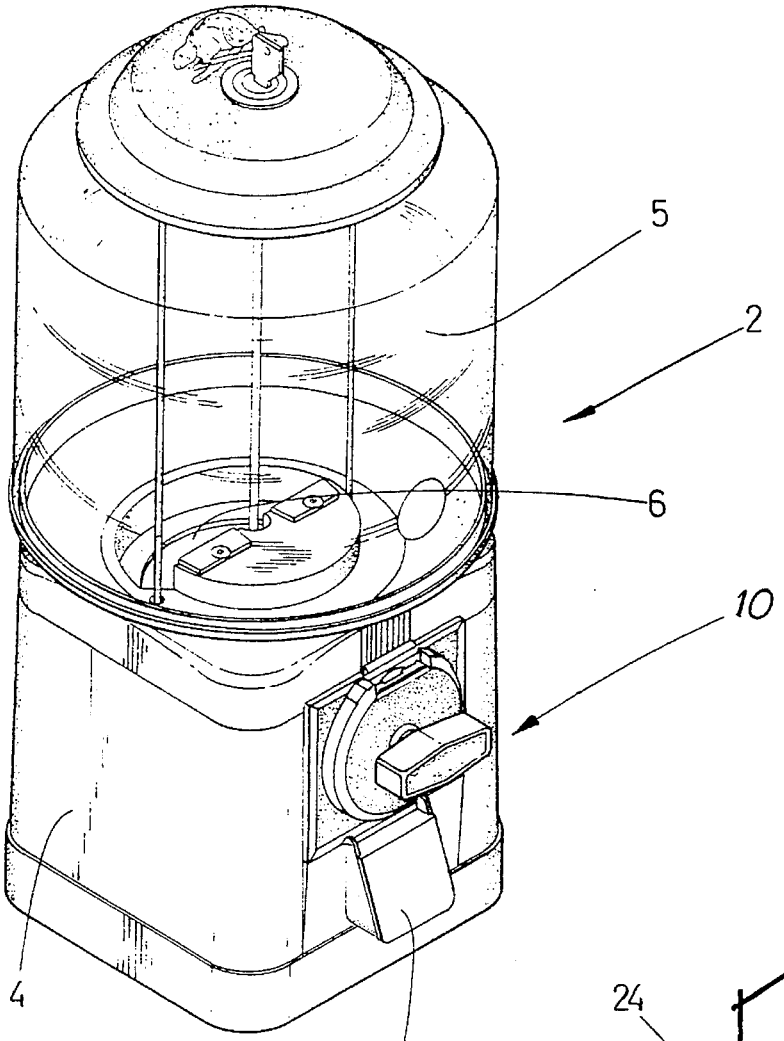
FIG. 1 is a perspective view of a bulk vendor embodying the coin mechanism of the invention.

FIG. 1 illustrates a merchandise-dispensing apparatus commonly known as a bulk vendor 2 in which the coin mechanism 10 of the invention may be employed. The vendor 2 conventionally includes a lower housing 4 enclosing the workings of the coin mechanism and a coin tray (not shown) for collecting deposited coins or tokens, a transparent article storage bin 5 for storing merchandise such as gumballs or other articles to be dispensed, and a turntable 6 which is rotated by rotation of the coin mechanism to align one of a plurality of product carriers with the opening to a dispensing chute 8, as is well known.

It will be understood that the coin mechanism of the invention will operate with any coin or token of the required size that contains a magnetic component. Thus, although the invention will be described with reference to a coin, the term "coin" as used herein includes coins and tokens and is in no way restricted to currency or coins having a monetary value. It will also be understood that the coin mechanism of the invention may be used in other types of apparatus which do not necessarily dispense merchandise, for example parking meters, and the invention is not restricted to any particular application of the coin mechanism.

Figure 2:
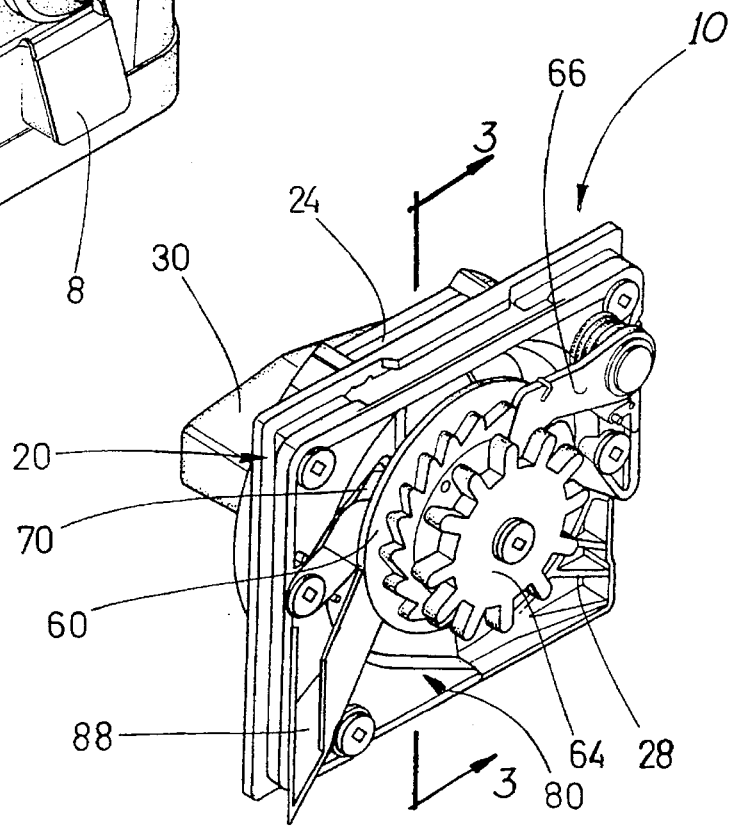
FIG. 2 is a rear perspective view of the coin mechanism according to the invention.
Figure 3:
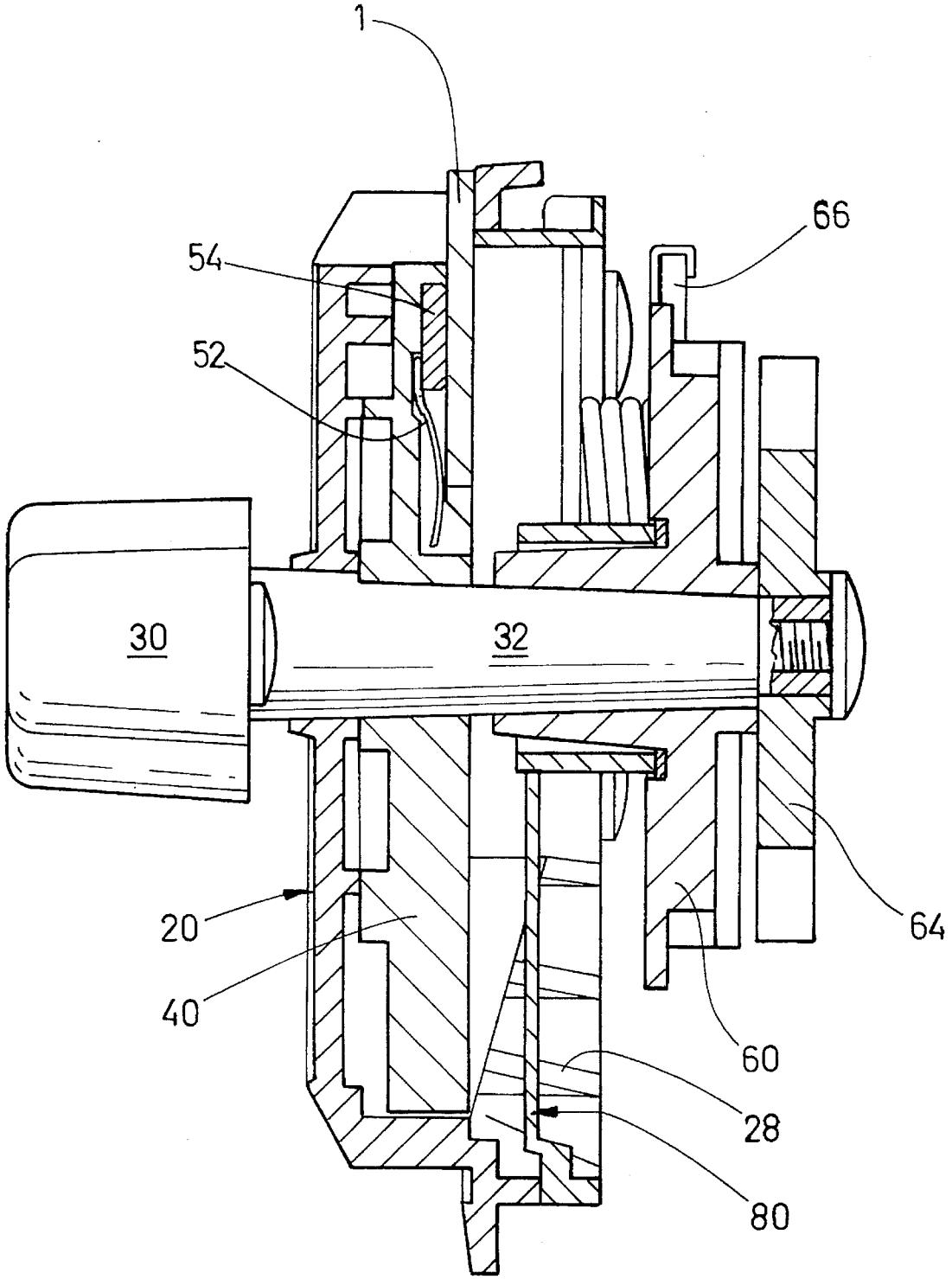
FIG. 3 is a cross section of the coin mechanism of FIG. 2.
Figure 4:
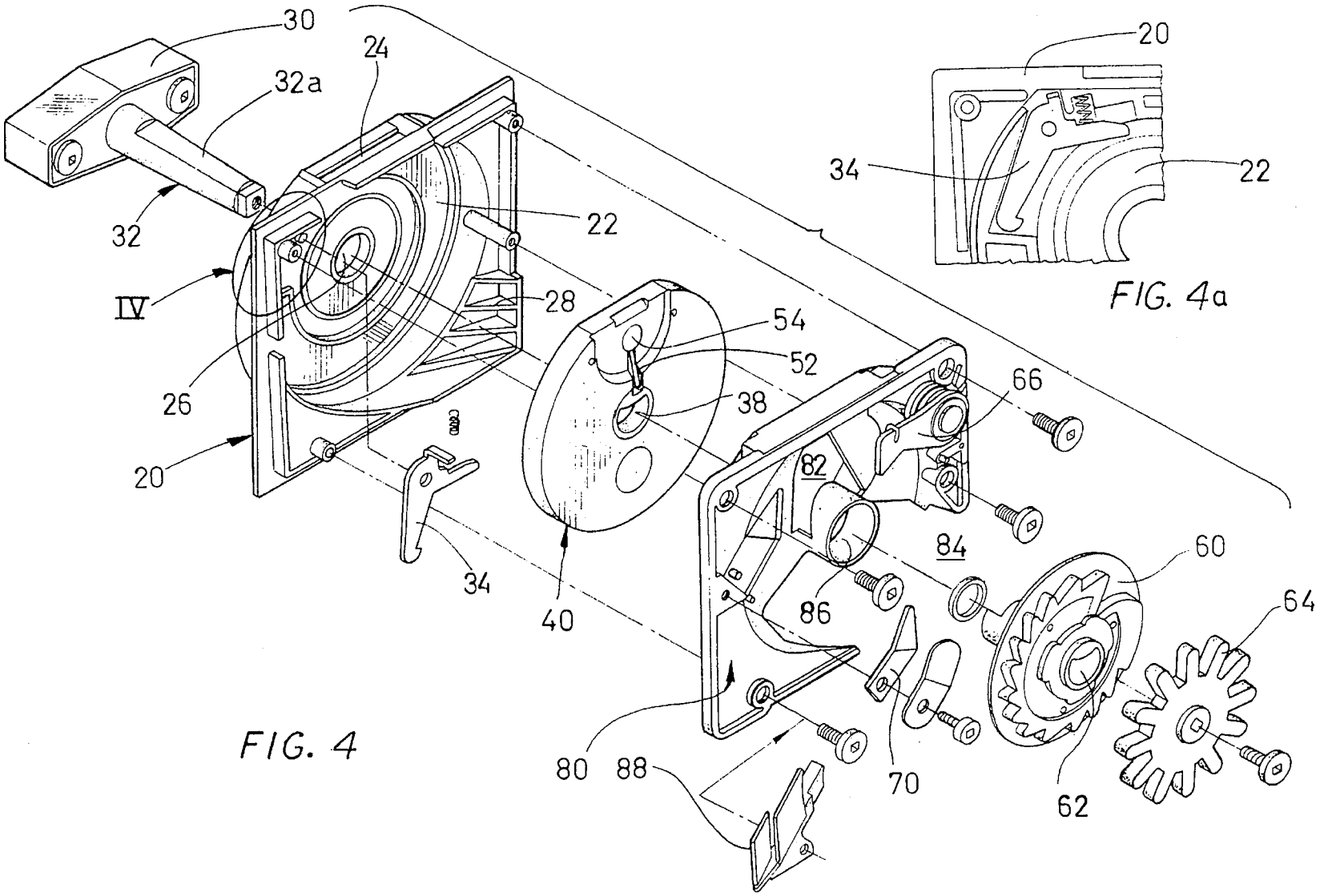
FIG. 4 is an exploded rear perspective view of the coin mechanism of FIG. 2.

FIGS. 2 to 4 illustrate a preferred embodiment of the coin mechanism 10 of the invention. The mechanism 10 comprises a cover plate 20 having a circular recess 22 into which a substantially disc-shaped coin conveyor 40 is disposed, a coin slot 24, and an opening 26 centred in the recess 22. A handle 30 having a tapered shaft 32 with a flat surface 32*a* extends through the opening 26 and engages an opening 38 disposed through the centre of the coin conveyor 40. The coin conveyor 40 includes carrying means for carrying a coin 1 comprising a coin carrier 42, which in the preferred embodiment comprises a recess dimensioned to receive the coin 1.

A back plate 80 overlays the coin conveyor 40 and is affixed to the cover plate 20. The back plate 80 includes an opening 82 through which rejected coins and slugs drop onto a coin rejection chute 88 and fall into the lower housing 4 of the vendor 2, and an opening 84 through which accepted coins are ejected from the coin conveyor 40 and deposited into a coin tray (not shown). The shaft 32 of the handle 30 extends through a central opening 86 in the back plate 80, through the hub 62 of a gear 60 which cooperates with a pawl 66 to prevent reverse rotation of the mechanism 10, and into a gear 64 for rotating the turntable 6.

Figure 10:
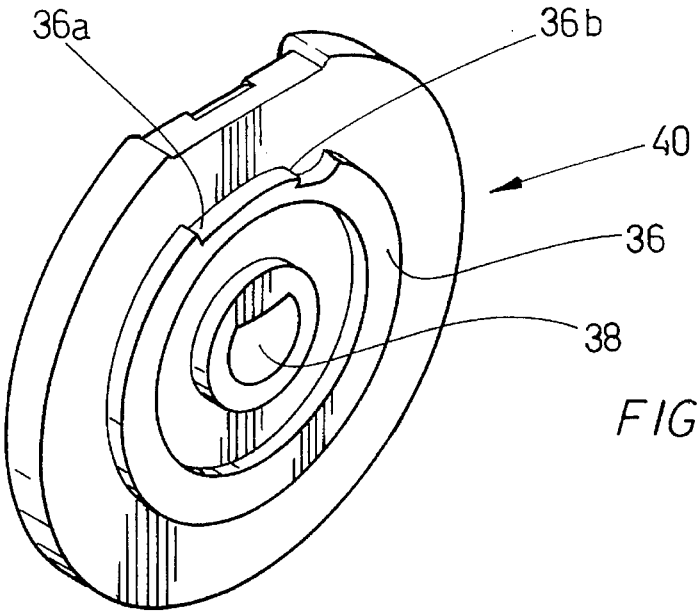
FIG. 10 is a front perspective view of the coin conveyor.

A first dog 70 for measuring the thickness of a coin 1 is mounted on the back plate 80 and catches the trailing edge of the coin carrier 42 if the inserted coin 1 does not have the correct thickness, to arrest rotation of the mechanism 10. A second dog 34 for measuring the diameter of the coin 1 is mounted on the cover plate 20, as shown in FIG. 4*a*, and catches one of two detents 36*a*, 36*b* formed in a raised edge 36 of the coin conveyor 40 (seen in FIG. 10) if the inserted coin 1 does not have the correct diameter, to arrest rotation of the mechanism 10.

The coin mechanism 10 described thus far is substantially as described and illustrated in U.S. Pat. No. 5,383,545 issued Jan. 24, 1995, which is incorporated herein by reference. The present invention consists of the provision of means for discriminating between coins that have a magnetic component and those that have no magnetic component. As used herein a coin has a magnetic component if it contains a sufficient quantity of a magnetic substance, such as iron, as to enable a magnetized element to generate an attractive force on the coin.

FIGS. 7 to 11 illustrate a preferred embodiment of the coin conveyor 40 in the coin mechanism 10 of the invention. The coin conveyor 40 is provided with a magnetized element such as a disc magnet 54, which is seated in a recess 48 in the the coin carrier 42, preferably generally centrally within the coin carrier 42 and so as to be flush with the seating surface 43. The magnet 54 preferably has a bevelled front edge 54*a* and is affixed in place by clinching around the periphery of the recess 48, as at 48*a* in FIGS. 7 and 8. The magnet 54 may alternatively be affixed in the recess 48 by epoxy or any other suitable means.

Figure 7:
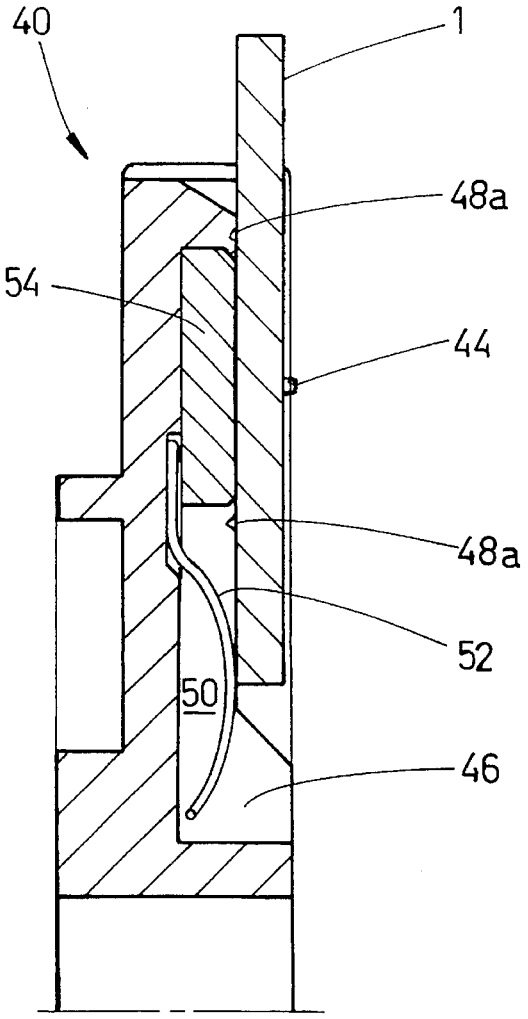
FIG. 7 is a partial cross section of the coin conveyor showing a coin in the coin carrier.
Figure 8:
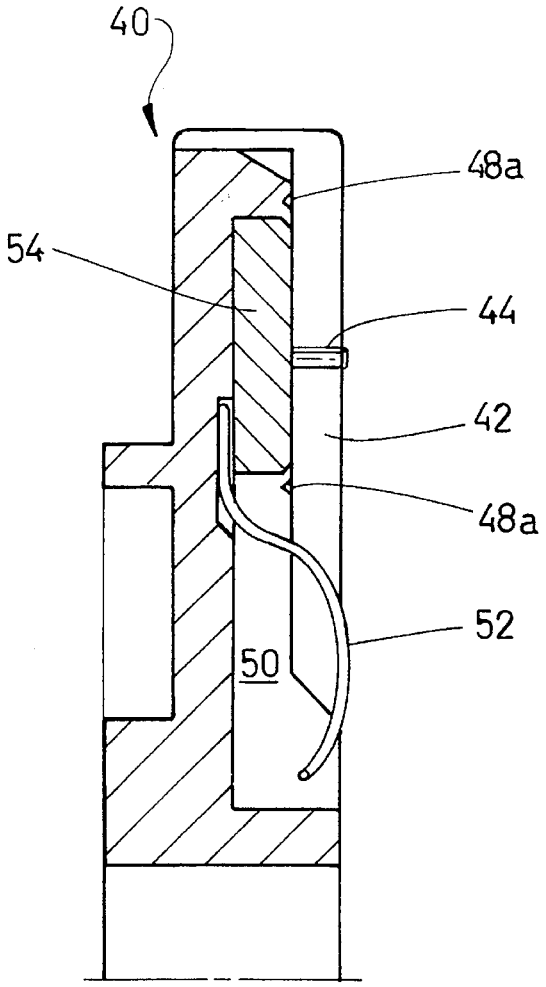
FIG. 8 is a partial cross section of the coin conveyor showing the coin carrier empty.
Figure 9:
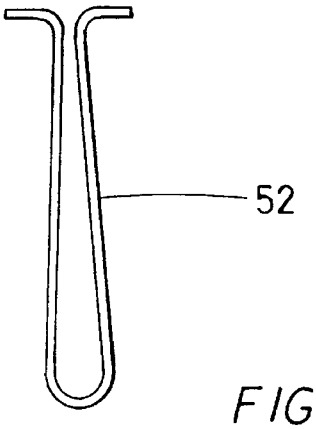
FIG. 9 is an elevation of the urging means.
Figure 11:
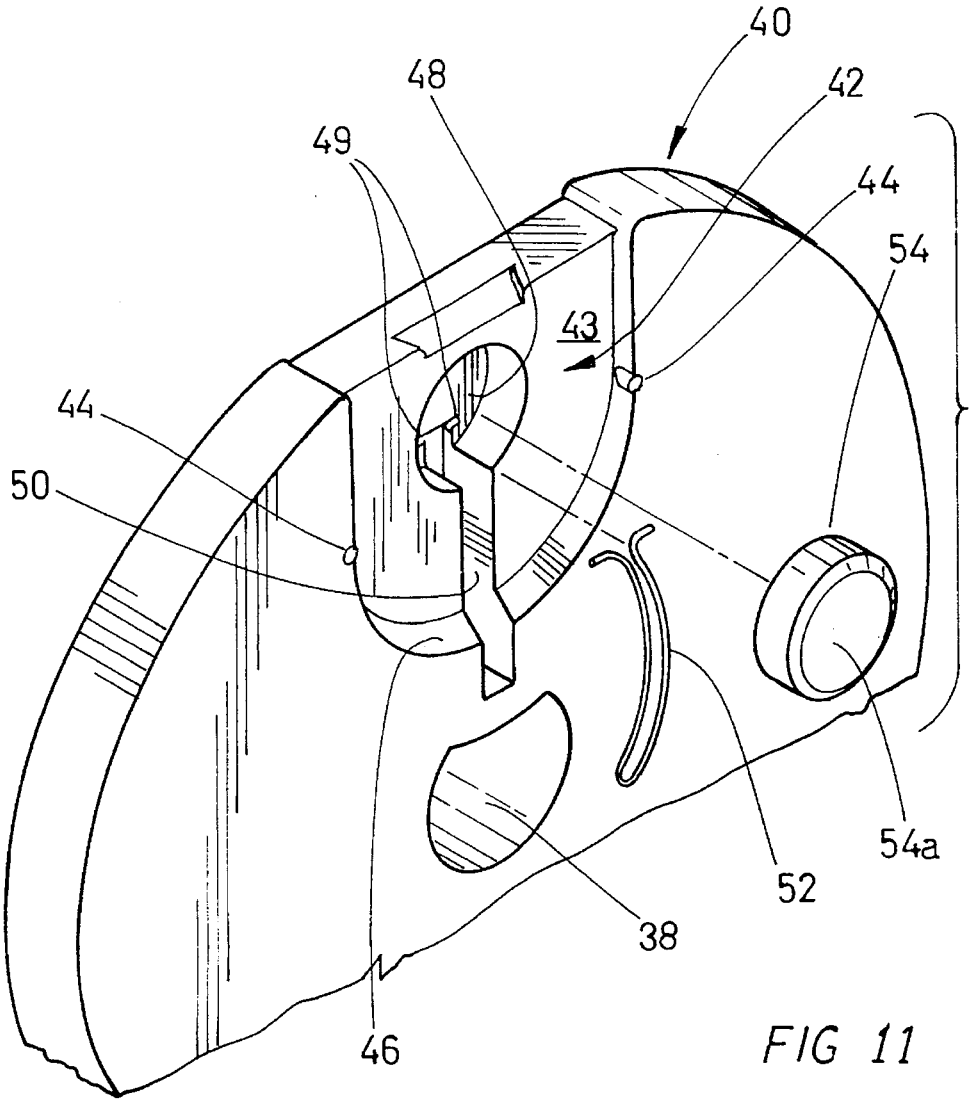
FIG. 11 is an exploded partial perspective view of the coin conveyor.

Urging means in a preferred embodiment comprises a spring 52 formed from resilient wire, illustrated in FIG. 9, mounted within a groove 50 so as to project from inside the groove 50 out beyond the seating surface 43 and thus into the recess defined by the coin carrier 42, as seen in FIG. 8. A pair of transverse furrows 49 is provided on the floor of the recess 48, as seen in FIG. 11, into which the ends of the wire spring 52 are respectively embedded so that when fixed in place the magnet 54 retains the spring 52 in position, as seen in cross section in FIGS. 7 and 8.

The groove 50 formed in the seating surface 43 of the coin carrier 42 extends from the recess 48 along the length of the spring 52, allowing the spring 52 to recede behind the seating surface 43 of the coin carrier 42 when depressed by a coin having a magnetic component, as seen in FIG. 7. Preferably the groove 50 is slightly longer than the uncompressed spring 52, so that when the spring 52 is depressed into the groove 50 it has room to expand lengthwise, which reduces somewhat the force required to depress the spring 52.

The magnet 54 can be a magnetized element or an electromagnet, although the former is preferred because of the problems associated with providing a power source in a bulk vendor. The urging means 52 can be any resilient element, such as a resilient wire, leaf spring, rubber block or filament etc., so long as the repelling force of the urging means against a coin having a magnetic component is less than the attractive force of the magnet 54 on the coin.

Figure 5:
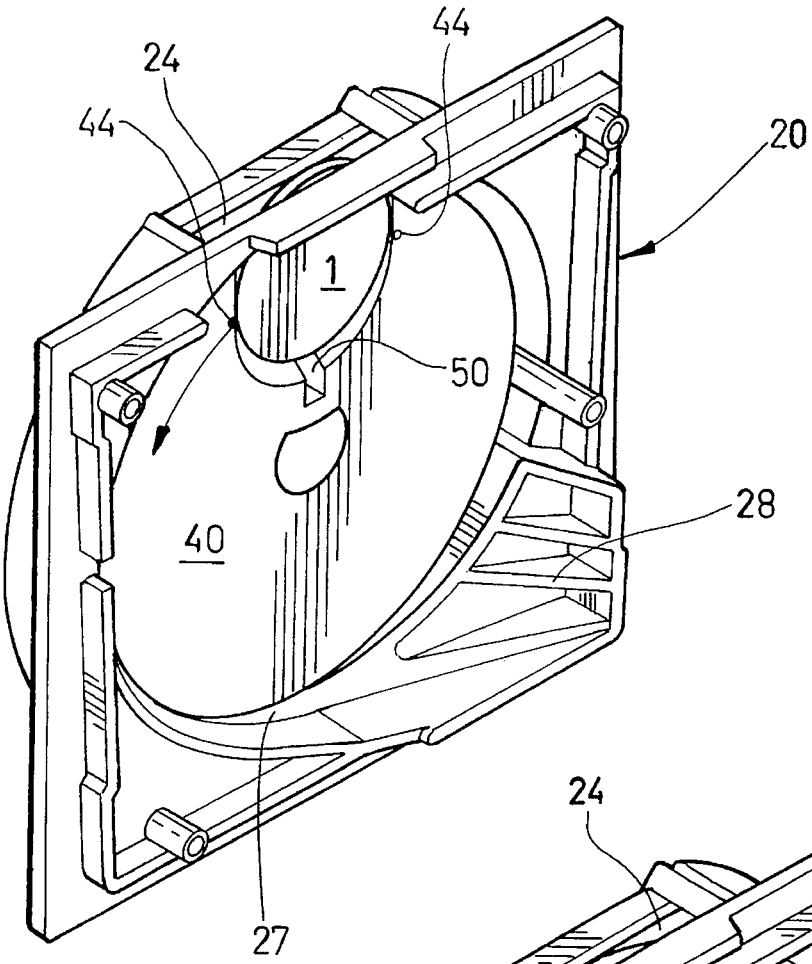
FIG. 5 is a rear perspective view of the cover plate showing the coin conveyor in a rest position.

In a preferred embodiment the coin carrier 42 includes coin supporting means comprising opposed pins or bosses 44 provided on either side of the coin carrier 42, as far apart as possible but just close enough together to support the coin 1 suspended slightly above the bottom edge 46 of the coin carrier 42, as shown in FIG. 5. Preferably the coin supporting means are hardened steel pins 44 embedded in the coin conveyor 40, which cannot be easily sheared off by forcing a coin or slug into the mechanism 10. The pins 44, best seen in FIG. 11, are disposed approximately flush with the face of the coin conveyor 40 and support the coin 1 in the precise position within the coin carrier 42 for proper measurement of the diameter of the coin 1 by the dog 34. Thus, when the coin 1 is properly seated in the coin carrier 42 in the rest position the coin 1 contacts only the seating surface 43 and the pins 44.

In operation, a coin 1 of the intended denomination, which in the case of the coin mechanism 10 of the invention will have a magnetic component, is deposited through the coin slot 24 and into the coin carrier 42 where it rests on the pins 44, as shown in FIG. 5. The magnet 54 attracts the coin 1 and seats it snugly against the seating surface 43 of the coin carrier 42, depressing the spring 52 into the groove 50. Because the attractive force of the magnet 54 on the coin 1 is greater than the repelling force of the spring 52 against the coin 1, the coin 1 is retained against the seating surface 43 as it travels along the rotational path of the coin carrier 42, ie. the path of travel of the coin 1.

As the user rotates the handle 30, in turn rotating the coin conveyor 40, the coin 1 is measured by the dogs 34, 70 before the "rotation threshold" is reached, which as defined herein is the point at which the coin 1 is accepted by the mechanism 10. Since in this example the coin 1 is of the proper denomination, rotation of the coin conveyor 40 continues beyond the rotation threshold and around the rotational path of the coin carrier 42.

Figure 6:
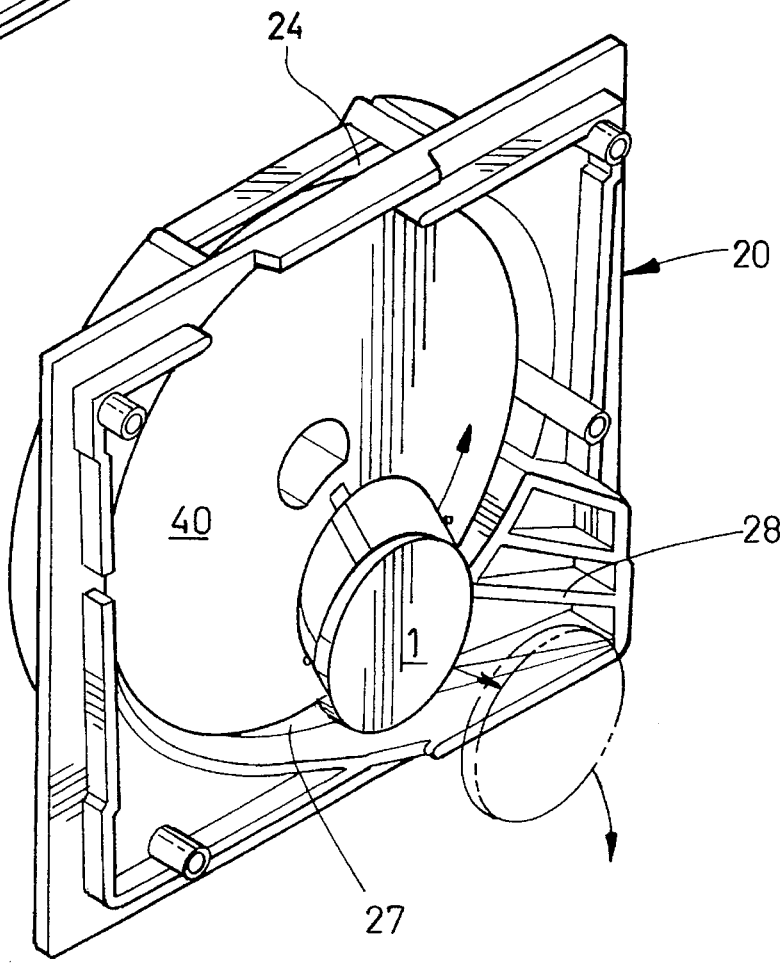
FIG. 6 is a rear perspective view of the cover plate showing the coin conveyor in a coin deposit position.

The cover plate 20 includes an ejection ramp 28 at a coin deposit position, extending rearwardly at an oblique angle. When the coin conveyor 40 reaches the coin deposit position the ejection ramp 28 pries the coin 1 sharply away from the magnet 54, as seen in FIG. 6, allowing the coin 1 to drop into a coin tray (not shown) stored within the housing 4 of the vendor 2. The mechanism 10 may if desired be provided with a gradually rising edge 27 along the periphery of the rotational path of the coin carrier 42 terminating at the ejection ramp 28, best seen in FIGS. 5 and 6, which gradually pries the coin 1 away from the magnet 54 and thus facilitates release of the coin 1 by the ejection ramp 28 at the coin deposit position.

As the handle 30 is rotated the gear 64 rotates the turntable 6 in the vendor 2, so that as the coin conveyor 40 is rotated back to the rest position (in which the coin carrier 40 is in substantial alignment with the coin slot 24, as in FIG. 5) the opening in one of the product carriers comes into alignment with the dispensing chute 8 and dispenses merchandise to the user.

The spring 52 preferably projects beyond the seating surface 43 at a point well spaced from the bottom edge 46 of the coin carrier 42, so that the edge of a coin or slug will contact the spring 52 before it contacts the pins 44. Thus, if a non-magnetic coin or slug is inserted into the coin carrier 40 the spring 52 will repel the coin or slug away from the seating surface 43 of the coin carrier 42 before the coin or slug contacts the pins 44, and eject it through the opening 82 in the back plate 80. The coin or slug will drop into the coin rejection chute 88 and fall into the vendor housing 4 at a point remote from the coin tray.

In a conventional coin mechanism the opening 82 in the back plate 80 is intended to reject undersized coins or slugs, and is accordingly smaller than a coin 1 of the intended denomination. In the coin mechanism 10 of the present invention, a coin of the proper denomination has a magnetic component and will be retained in the coin carrier 42 by the magnet 54. Thus, the opening 82 is preferably larger than a coin of the intended denomination so that any coin or slug having no magnetic component, whether oversized or undersized, will be repelled through the opening by the spring 52 and rejected.

If an undersized coin or slug having a magnetic component is inserted into the coin carrier 42, one of the dogs 34, 70 will arrest rotation of the coin mechanism 10 before it reaches the rotation threshold, as is conventional. However, the attractive force of the magnet 54 will retain the coin or slug against the seating surface 43. The undersized coin or slug may be removed through the coin slot 24 using a sharp instrument; alternatively, the next coin inserted into the coin carrier 42 will force the undersized coin or slug past (ie. between) the supporting pins 44. The coin carrier 42 preferably has a chamfered or bevelled bottom edge 46, so that an undersized coin or slug held in place by the magnet 54 will not become trapped against the bottom edge of the coin carrier 42, but will slide along the bevelled bottom edge 46, through the opening 82 in the back plate 80 and into the coin rejection chute 88.

Oversized coins and slugs inserted into the coin slot 24 which are to large to seat in the coin carrier 42, whether or not they contain a magnetic component, will catch on the edge of the cover plate 20 so that the coin conveyor 40 cannot be rotated to the rotation threshold. In the case of cardboard slugs which can be worn down through persistent rotation of the coin conveyor 40, once the slug has worn to a size which permits it to fit through the opening 82 in the back plate 80 the spring 52 will eject the slug through the opening 82 and it will drop into the coin rejection chute 88.

It can thus be seen that the coin mechanism 10 of the present invention will discriminate between coins and slugs having a magnetic component and those having no magnetic component, without interfering with the coin measuring devices. This considerably narrows down the range of metal coins and slugs which will be accepted by the coin mechanism 10, and eliminates the possibility of acceptance of cardboard and plastic slugs.

The invention having been thus described with reference to a preferred embodiment, it will be apparent to those skilled in the art that variations and modifications of the invention may be made without departing from the scope of the invention, as set out in the appended claims.

I claim:

1. A coin mechanism for a merchandise-dispensing apparatus, comprising a rotatably mounted coin conveyor connected to means for rotating the coin conveyor and means for dispensing merchandise from the apparatus responsive to rotation of the coin conveyor, the coin conveyor including carrying means for carrying a coin or token along a rotational path of the carrying means, a cover plate having an opening for the insertion of a coin or token in substantial alignment with the carrying means when the coin conveyor is in a rest position, the carrying means being provided with magnetized means for attracting a coin or token having a magnetic component and retaining same in the carrying means and urging means for repelling a coin or token having no magnetic component and unseating same from the carrying means, whereby an attractive force of the magnetized means is greater than a repelling force of the urging means, and means for releasing the coin or token from the carrying means as the coin conveyor is rotated past a coin deposit position.

2. The mechanism of claim 1 in which the coin carrier comprises a recess in the coin conveyor.

3. The mechanism of claim 2 in which the magnetized means comprises a magnet disposed within the coin carrier.

4. The mechanism of claim 3 in which the magnet is flush with a coin seating surface of the coin carrier.

5. The mechanism of claim 3 in which the urging means comprises a spring retained in position behind the magnet.

6. The mechanism of claim 1 in which the urging means comprises a resilient element projecting beyond a seating surface of the coin carrier.

7. The mechanism of claim 1 in which a seating surface of the coin carrier is provided with a groove into which the urging means can be depressed under the attractive force of the magnet on a coin or token having a magnetic component.

8. The mechanism of claim 1 in which the means for releasing the coin or token comprises a ramp provided along the rotational path of the carrying means.

9. The mechanism of claim 8 in which the ramp comprises an ejection ramp disposed at the coin deposit position.

10. The mechanism of claim 8 in which the ramp includes a gradually rising edge disposed along the rotational path of the carrying means.

11. An apparatus for dispensing merchandise having a coin mechanism comprising a rotatably mounted coin conveyor connected to means for rotating the coin conveyor and means for dispensing merchandise from the apparatus responsive to rotation of the coin conveyor, the coin conveyor including carrying means for carrying a coin or token along a rotational path of the carrying means, a cover plate having an opening for the insertion of a coin or token in substantial alignment with the carrying means when the coin conveyor is in a rest position, the carrying means being provided with magnetized means for attracting a coin or token having a magnetic component and retaining same in the carrying means and urging means for repelling a coin or token having no magnetic component and unseating same from the carrying means, whereby an attractive force of the magnetized means is greater than a repelling force of the urging means, and means for releasing the coin or token from the carrying means as the coin conveyor is rotated past a coin deposit position.

12. The apparatus of claim 11 in which the coin carrier comprises a recess in the coin conveyor.

13. The apparatus of claim 12 in which the magnetized means comprises a magnet disposed within the coin carrier.

14. The apparatus of claim 13 in which the magnet is flush with a coin seating surface of the coin carrier.

15. The apparatus of claim 13 in which the urging means comprises a spring retained in position behind the magnet.

16. The apparatus of claim 11 in which the urging means comprises a resilient element projecting beyond a seating surface of the coin carrier.

17. The apparatus of claim 11 in which a seating surface of the coin carrier is provided with a groove into which the urging means can be depressed under the attractive force of the magnet on a coin or token having a magnetic component.

18. The apparatus of claim 11 in which the means for releasing the coin or token comprises a ramp provided along the rotational path of the carrying means.

19. The apparatus of claim 18 in which the ramp comprises an ejection ramp disposed at the coin deposit position.

20. The apparatus of claim 18 in which the ramp comprises a gradually rising edge disposed along the rotational path of the carrying means.

* * * * *